US012800180B2

(12) United States Patent
Han et al.

(10) Patent No.: US 12,800,180 B2
(45) Date of Patent: Nov. 17, 2026

(54) AIR CONDITIONER AND CONTROL METHOD THEREOF

(71) Applicant: Samsung Electronics Co., Ltd., Suwon-si (KR)

(72) Inventors: Daechul Han, Suwon-si (KR); Youngjin Kim, Suwon-si (KR); Hyoju Moon, Suwon-si (KR); Beomseok Seo, Suwon-si (KR); Leegyu Son, Suwon-si (KR); Seungcheon Yu, Suwon-si (KR); Sungjin In, Suwon-si (KR); Youngjun Choi, Suwon-si (KR); Dongsu Ha, Suwon-si (KR); Manki Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 74 days.

(21) Appl. No.: 18/652,494

(22) Filed: May 1, 2024

(65) Prior Publication Data

US 2024/0280287 A1 Aug. 22, 2024

Related U.S. Application Data

(63) Continuation of application No. PCT/KR2022/017980, filed on Nov. 15, 2022.

(30) Foreign Application Priority Data

Jan. 12, 2022 (KR) ..... 10-2022-0004655

(51) Int. Cl.
*F24F 11/86* (2018.01)
*F24F 11/63* (2018.01)

(52) U.S. Cl.
CPC ..... *F24F 11/86* (2018.01); *F24F 11/63* (2018.01)

(58) Field of Classification Search
CPC ..... F24F 11/86; F24F 11/63; F24F 2110/10; F24F 2110/20
See application file for complete search history.

(56) References Cited

U.S. PATENT DOCUMENTS 7,987,680 B2 8/2011 Hamada et al.
2010/0257884 A1 10/2010 Matsui
(Continued)

FOREIGN PATENT DOCUMENTS

CN 106524423 A 3/2017
CN 105135618 B 2/2018
(Continued)

OTHER PUBLICATIONS

International Search Report for PCT/KR2022/017980 mailed Mar. 8, 2023, 4 pages.
(Continued)

*Primary Examiner* — Lionel Nouketcha
(74) *Attorney, Agent, or Firm* — Nixon & Vanderhye, P.C.

(57) ABSTRACT

An example air conditioner may include a compressor configured to compress a refrigerant; an indoor heat exchanger configured to perform heat exchange between the refrigerant and indoor air; a temperature sensor configured to measure an indoor temperature and an indoor heat exchanger temperature; an input device configured to receive a target temperature and target humidity from a user; and at least one processor configured to determine an adjustment value of an operating frequency of the compressor based on a temperature difference between the target temperature and the indoor temperature, and change the determined adjustment value of the operating frequency based on the target humidity and the indoor heat exchanger temperature.

17 Claims, 12 Drawing Sheets

(56) References Cited

U.S. PATENT DOCUMENTS

| | | | | |
|---|---|---|---|---|
| 2018/0313554 | A1* | 11/2018 | Henderson | F24F 11/30 |
| 2020/0132319 | A1 | 4/2020 | Kim et al. | |

FOREIGN PATENT DOCUMENTS

| | | | | | |
|---|---|---|---|---|---|
| CN | 111720962 | A | | 9/2020 | |
| CN | 111023401 | B | | 3/2021 | |
| CN | 112240633 | B | | 10/2022 | |
| JP | 2003322385 | A | | 11/2003 | |
| JP | 2007132646 | A | | 5/2007 | |
| JP | 2008128608 | A | | 6/2008 | |
| JP | 4378974 | B2 | | 10/2009 | |
| JP | 5396705 | B2 | | 11/2013 | |
| JP | 2015001310 | A | * | 1/2015 | F24F 11/30 |
| JP | 5812570 | B2 | | 10/2015 | |
| JP | 5983235 | B2 | | 8/2016 | |
| JP | 2021050907 | A | | 4/2021 | |
| JP | 2021103053 | A | | 7/2021 | |
| KR | 100512278 | B1 | | 9/2005 | |
| KR | 20170090837 | A | | 8/2017 | |
| KR | 20180080727 | A | | 7/2018 | |
| KR | 20210049449 | A | | 5/2021 | |
| WO | 2020035909 | A1 | | 2/2020 | |

OTHER PUBLICATIONS

Written Opinion of the ISA for PCT/KR2022/017980 mailed Mar. 8, 2023, 4 pages.

Office Action dated Jun. 29, 2026 in Korean Application No. 10-2022-0004655 with English translation.

* cited by examiner

FIG. 7

E = DIFFERENCE BETWEEN INDOOR TEMPERATURE AND TARGET TEMPERATURE
⊿E = AMOUNT OF INDOOR TEMPERATURE CHANGE FOR ONE MINUTE

| ⊿f * 10 | Index | 6 | 5 | 4 | 3 |
|---|---|---|---|---|---|
| Index | ⊿E<br>E | +0.6 | +0.4 | +0.2 | 0 |
| 0 | −3.0 | −f2 | −f6 | −f6 | −f12 |
| 1 | −2.5 | −f1 | −f4 | −f4 | −f9 |
| 2 | −2.0 | 0 | −f2 | −f2 | −f4 |
| 3 | −1.5 | f1 | −f1 | −f1 | −f4 |
| 4 | −1.0 | f2 | 0 | 0 | −f2 |

AIR CONDITIONER AND CONTROL METHOD THEREOF

CROSS-REFERENCE TO RELATED APPLICATIONS

This application is a continuation of International Application No. PCT/KR2022/017980, designating the United States, filed on Nov. 15, 2022, in the Korean Intellectual Property Receiving Office and claiming priority to Korean Patent Application No. 10-2022-0004655, filed on Jan. 12, 2022, in the Korean Intellectual Property Office, the disclosures of each of which are incorporated by reference herein in their entireties.

BACKGROUND

Field

The disclosure relates to an air conditioner that may manage indoor humidity, and a control method thereof.

Description of Related Art

An air conditioner is a device that conditions air in an indoor space using a transfer of heat generated during evaporation and condensation of a refrigerant to cool or heat air, and discharging the cooled or heated air. An air conditioner may cool or heat air by circulating refrigerant through a compressor, an indoor heat exchanger, and an outdoor heat exchanger during cooling or heating operations.

In general, air conditioners may only set a target temperature, and do not have a function to control indoor humidity. Air conditioners control a compressor during cooling operation to ensure that an indoor temperature reaches a set target temperature.

However, air conditioners affect a temperature of an indoor heat exchanger due to excessive deceleration of a compressor when reaching the target temperature, causing an indoor space to become humid.

SUMMARY

In an embodiment, an air conditioner and a control method thereof may be provided that may set target humidity by a user input and prevent an increase in indoor humidity.

According to an embodiment of the disclosure, an air conditioner may include a compressor configured to compress a refrigerant; an indoor heat exchanger configured to perform heat exchange between the refrigerant and indoor air; a temperature sensor configured to measure an indoor temperature and an indoor heat exchanger temperature; an input device configured to receive a target temperature and target humidity from a user; and at least one processor configured to determine an adjustment value of an operating frequency of the compressor based on a temperature difference between the target temperature and the indoor temperature, and change the determined adjustment value of the operating frequency based on the target humidity and the indoor heat exchanger temperature.

In an embodiment, the controller may be configured to change the adjustment value, in response to a difference between the indoor heat exchanger temperature and a dew point temperature being greater than a specified weight.

In an embodiment, the controller may be configured to obtain the dew point temperature based on the target temperature and the target humidity.

In an embodiment, the controller may be configured to change the adjustment value to allow the indoor heat exchanger temperature to be maintained below the dew point temperature.

In an embodiment, the air conditioner may further include a humidity sensor configured to measure indoor humidity, and the controller may be configured to change the adjustment value in response to the indoor humidity obtained from the humidity sensor being equal to or greater than the target humidity.

In an embodiment, the controller may be configured to maintain the operating frequency of the compressor by changing the adjustment value of the operating frequency to 0.

In an embodiment, the controller may be configured to determine a magnitude of the changed adjustment value based on the target humidity.

In an embodiment, the controller may be configured to determine the temperature difference and an adjustment value of the operating frequency corresponding to a change value of the temperature difference with reference to a pre-stored fuzzy table.

In an embodiment, the controller may be configured to change the adjustment value of the operating frequency before the indoor temperature reaches the target temperature.

In an embodiment, the controller may be configured to change the adjustment value, from a time that the temperature difference is equal to or less than a predetermined temperature difference.

In an embodiment, a control method of an air conditioner, which includes a compressor configured to compress a refrigerant, an indoor heat exchanger configured to perform heat exchange between the refrigerant and indoor air, a temperature sensor configured to measure an indoor temperature and an indoor heat exchanger temperature, and an inputter configured to receive a target temperature and target humidity from a user, may include determining an adjustment value of an operating frequency of the compressor based on a temperature difference between the target temperature and the indoor temperature; and changing the determined adjustment value of the operating frequency based on the target humidity and the indoor heat exchanger temperature.

In an embodiment, the changing of the adjustment value of the operating frequency may include changing the adjustment value, in response to a difference between the indoor heat exchanger temperature and a dew point temperature being greater than a predetermined weight.

In an embodiment, the control method of the air conditioner may include obtaining the dew point temperature based on the target temperature and the target humidity.

In an embodiment, the changing of the adjustment value of the operating frequency may include changing the adjustment value to allow the indoor heat exchanger temperature to be maintained below the dew point temperature.

In an embodiment, the air conditioner may include a humidity sensor configured to measure indoor humidity, and the changing of the adjustment value of the operating frequency may include changing the adjustment value, in response to the indoor humidity obtained from the humidity sensor being equal to or greater than the target humidity.

In an embodiment, the changing of the adjustment value of the operating frequency may include maintaining the operating frequency of the compressor by changing the adjustment value of the operating frequency to 0.

In an embodiment, the changing of the adjustment value of the operating frequency may include determining a magnitude of the changed adjustment value based on the target humidity.

In an embodiment, the changing of the adjustment value of the operating frequency may include determining the temperature difference and an adjustment value of the operating frequency corresponding to a change value of the temperature difference with reference to a pre-stored fuzzy table.

In an embodiment, the changing of the adjustment value of the operating frequency may include changing the adjustment value of the operating frequency before the indoor temperature reaches the target temperature.

In an embodiment, the changing of the adjustment value of the operating frequency may include changing the adjustment value, from a time that the temperature difference is equal to or less than a predetermined temperature difference.

According to various embodiments of the disclosure, an air conditioner may, for example, provide pleasant air by controlling indoor humidity by adjusting an indoor temperature without a separate dehumidification device. For example, various embodiments of the disclosure may set target humidity and, in response to the input target humidity, may appropriately control an operating frequency of a compressor during fuzzy control, thereby providing pleasant air in accordance with the target humidity.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIG. 7 illustrates a fuzzy table of an example air conditioner according to various embodiments;

DETAILED DESCRIPTION

Figure 1:
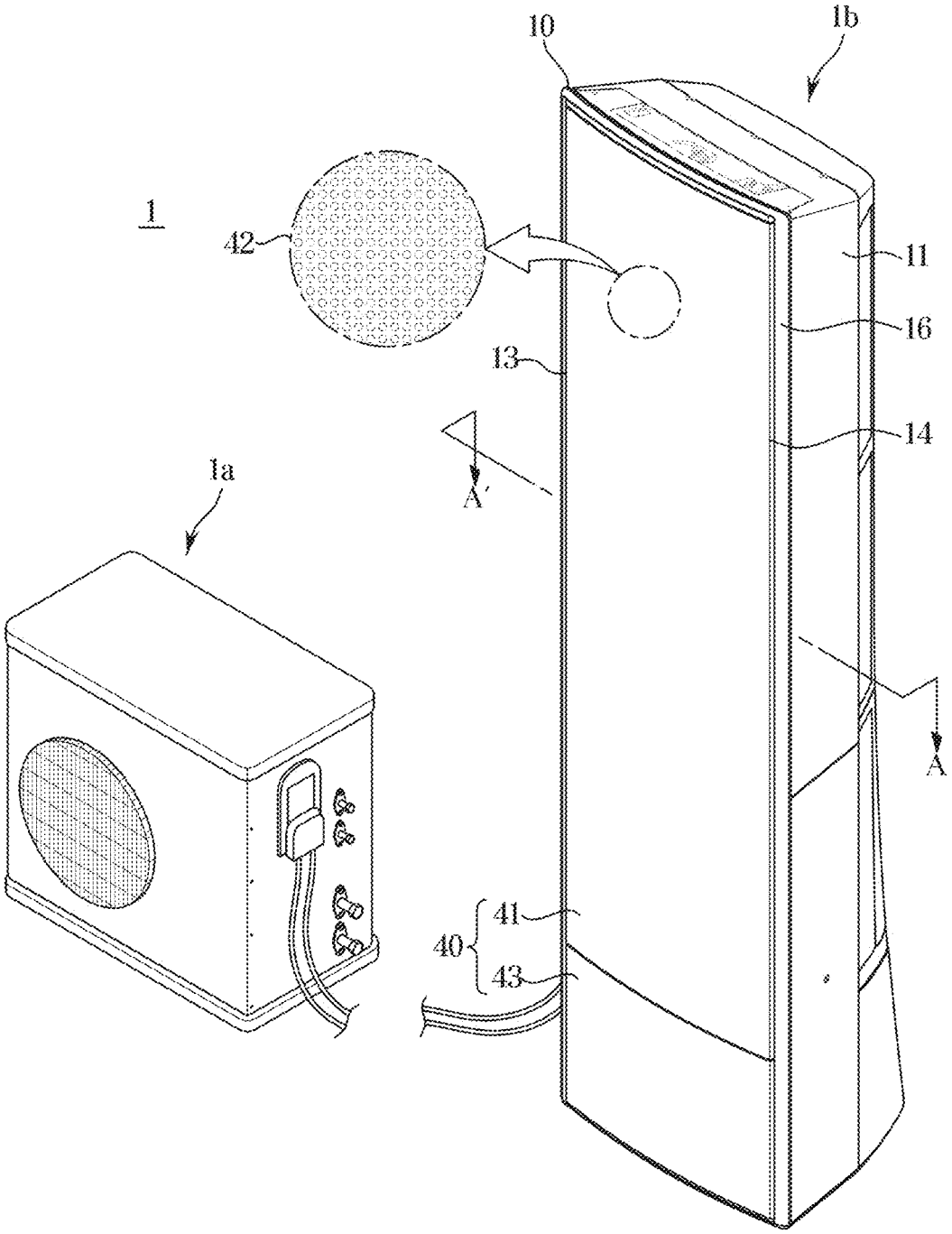
FIG. 1 is an exterior view of an example air conditioner according to various embodiments.

Like reference numerals throughout the disclosure denote like elements. Also, this disclosure may not describe all elements according to various embodiments of the disclosure, and descriptions well-known in the art to which the disclosure pertains or overlapped portions may be omitted for brevity and clarity. Terms such as "~portion", "~block", "~member", "~module", and the like may be implemented in hardware or software or any combination thereof. According to various embodiments, a plurality of "~portions", "~blocks", "~members", or "~modules" may be embodied as a single element, or a single "~portion", "~block", "~member", or "~module" may include a plurality of elements.

Throughout the disclosure, it will be understood that when an element is referred to as being "connected" to another element, it may be directly or indirectly connected to the other element, wherein the indirect connection includes, for example, "connection" via a wireless communication network.

It will be further understood that the term "include" when used in this disclosure, specifies the presence of stated elements, but does not preclude the presence or addition of one or more other elements.

It will also be understood that when one component is referred to as being "on" another component, it may be directly on the other component or another component may also be present (e.g., between the components).

Although the terms "first", "second", etc. may be used to describe different components, the terms do not limit the corresponding components, but are used simply for the purpose of distinguishing one component from another.

A singular form of a noun corresponding to an item may include one item or a plurality of the items unless context clearly indicates otherwise.

Reference numerals used for method steps are simply used for convenience of explanation, but not to limit an order of the steps. Thus, unless the context clearly dictates otherwise, the written order may be practiced otherwise.

Hereinafter, various embodiments of the disclosure are described in greater detail with reference to the accompanying drawings.

Figure 2:
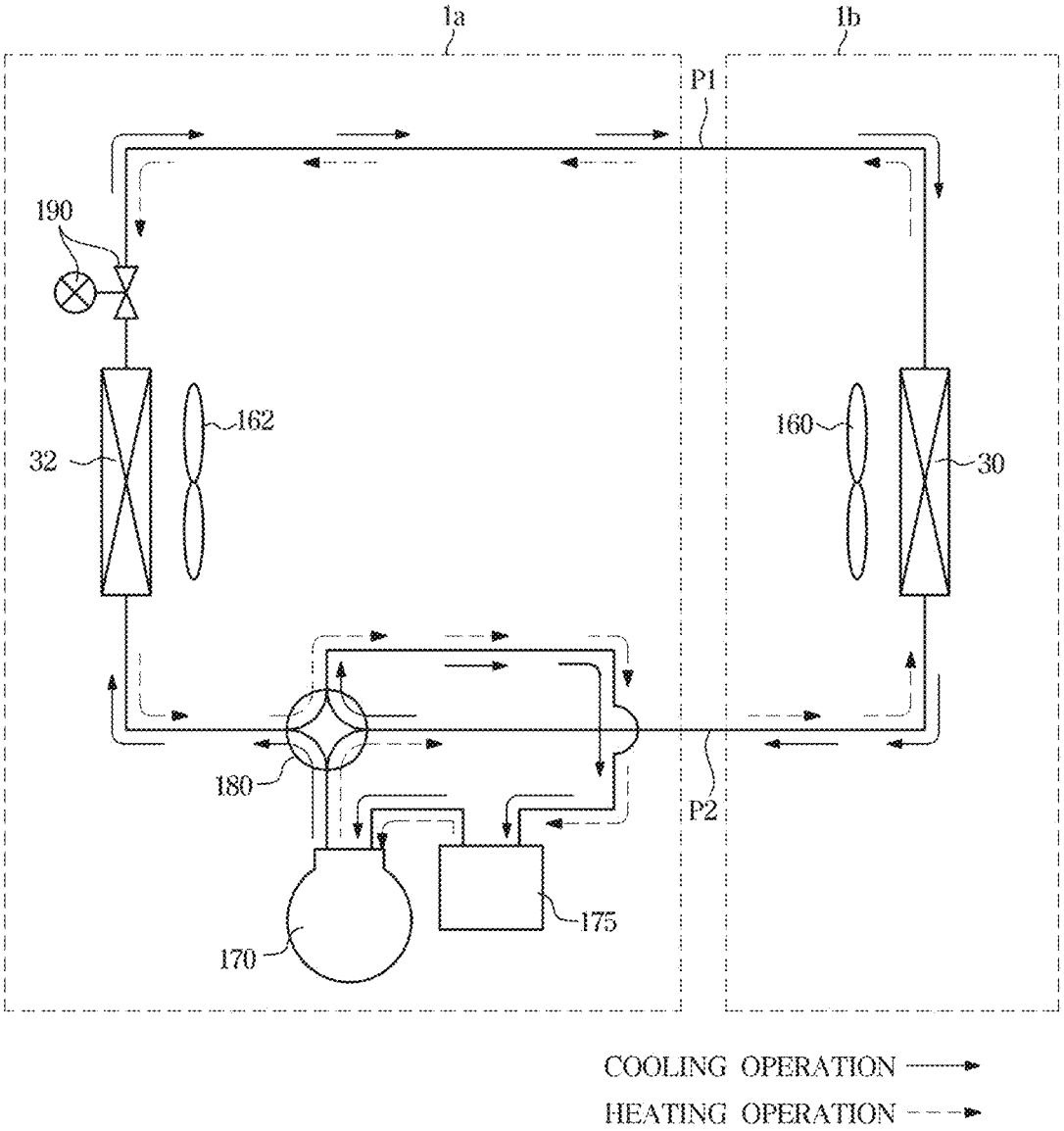
FIG. 2 illustrates a flow of a refrigerant during a heating operation or a cooling operation of an example air conditioner according to various embodiments.
Figure 3:
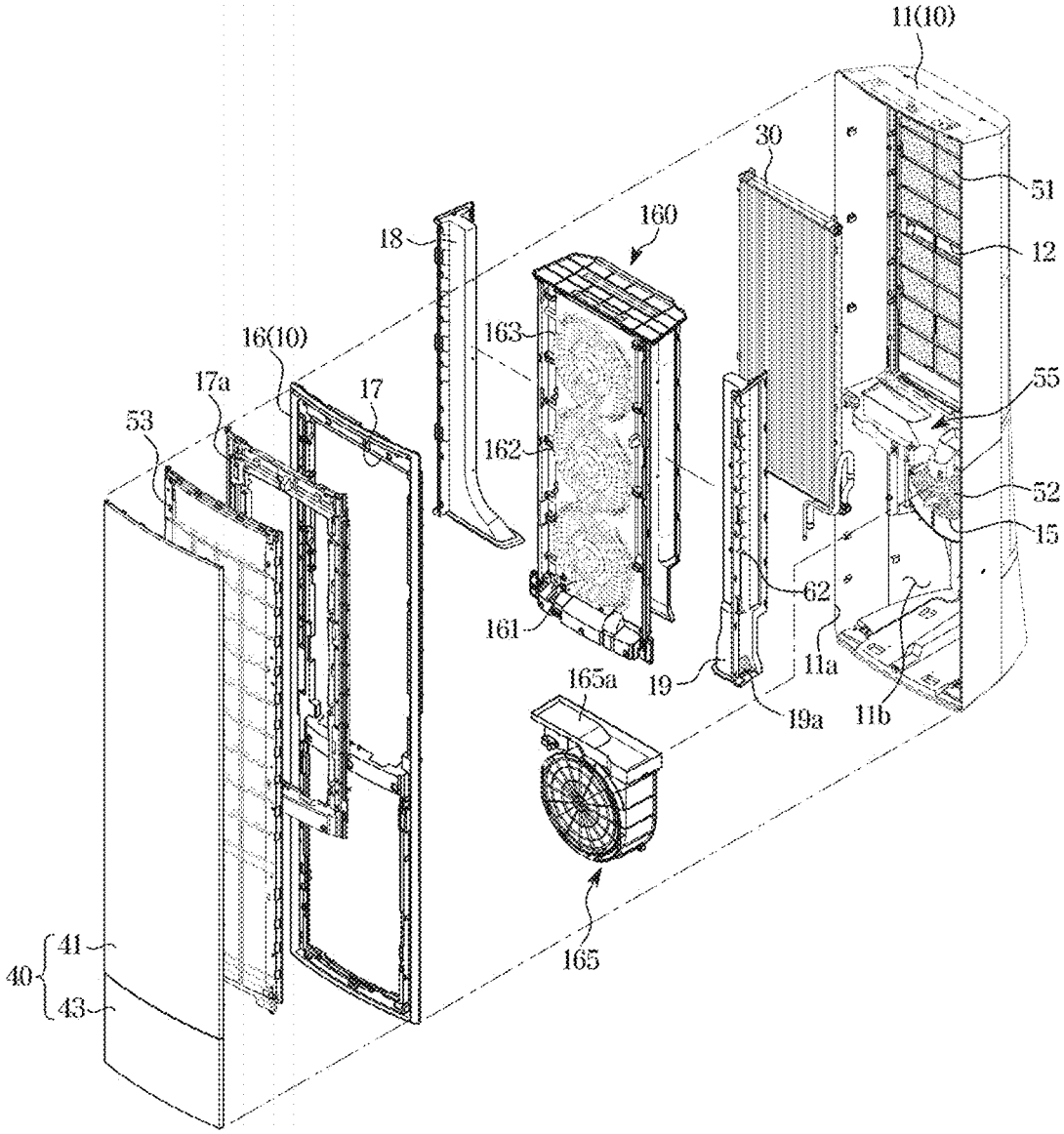
FIG. 3 is an exploded view of an example air conditioner according to various embodiments.
Figure 4:
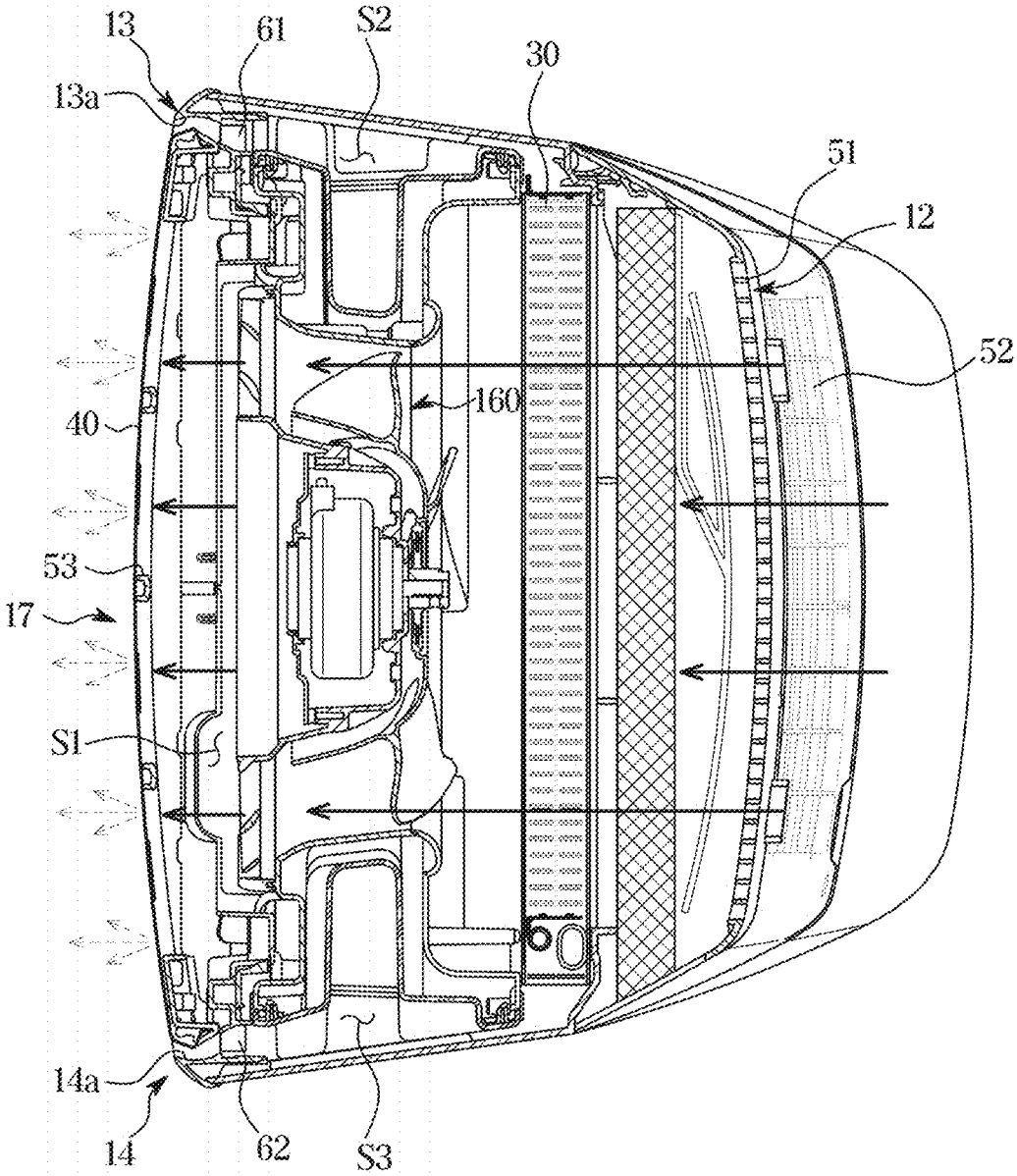
FIG. 4 is a cross-sectional view of an example air conditioner according to various embodiments, illustrating air flow through a first flow path.
Figure 5:
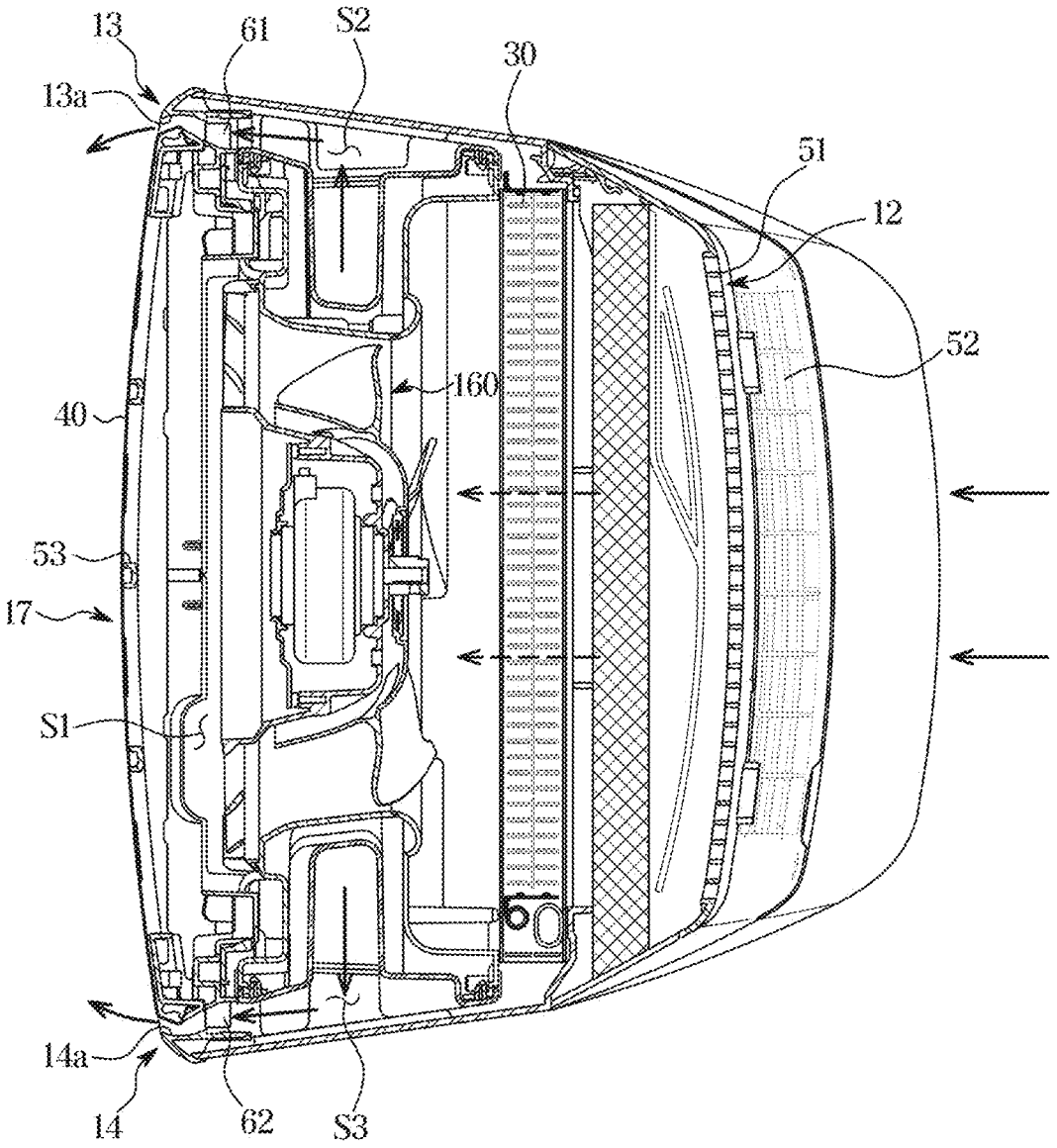
FIG. 5 is a cross-sectional view of an example air conditioner according to various embodiments, illustrating air flow through a second flow path.

FIG. 1 is an exterior view of an example air conditioner according to various embodiments. FIG. 2 illustrates a flow of a refrigerant during a heating operation or a cooling operation of an example air conditioner according to various embodiments. FIG. 3 is an exploded view of an example air conditioner according to various embodiments. FIG. 4 is a cross-sectional view of an example air conditioner according to various embodiments, illustrating air flow through a first flow path. FIG. 5 is a cross-sectional view of an example air conditioner according to various embodiments, illustrating air flow through a second flow path.

Referring to FIG. 1, an air conditioner 1 includes an outdoor unit 1*a* located in an outdoor space to perform heat exchange between outdoor air and a refrigerant, and an indoor unit 1*b* located in an indoor space to perform heat exchange between indoor air and refrigerant. The outdoor unit 1*a* may be located outside an air conditioning space, and the indoor unit 1*b* may be located in the air conditioning space. The air conditioning space represents a space cooled or heated by the air conditioner 1. For example, the outdoor unit 1*a* may be placed outside a building, and the indoor unit 1*b* may be placed in a space separated from the outside by a wall, such as a living room or office.

Referring to FIG. 2, the air conditioner 1 includes a refrigerant flow path for circulating a refrigerant between the indoor unit 1*b* and the outdoor unit 1*a*. The refrigerant circulates through the indoor unit 1*b* and the outdoor unit 1*a* along the refrigerant flow path, and may absorb or release heat through a state change (e.g., a state change from gas to liquid, or a state change from liquid to gas). The air conditioner 1 includes a liquid pipe P1 connecting the outdoor unit 1*a* and the indoor unit 2*b* and serving as a passage through which liquid refrigerant flows, and a gas pipe P2 through which gaseous refrigerant flows. The liquid pipe P1 and the gas pipe P2 extend inside the outdoor unit 1*a* and the indoor unit 1*b*.

The outdoor unit 1*a* includes a compressor 170 compressing the refrigerant, an outdoor heat exchanger 32 performing heat exchange between outdoor air and the refrigerant, a four-way valve 180 guiding the refrigerant compressed by the compressor 170 to the outdoor heat exchanger 32 or an indoor heat exchanger 30 based on cooling operation or heating operation, an expansion valve 190 decompressing the refrigerant, and an accumulator 175 preventing unevaporated liquid refrigerant from flowing into the compressor 170.

The compressor 170 may operate by receiving electric energy from an external power source. The compressor 170 includes a compressor motor (not shown) and compresses low-pressure gaseous refrigerant to a high pressure gaseous refrigerant using a rotational force of the compressor motor.

The four-way valve 180 guides the refrigerant compressed by the compressor 170 to the outdoor heat exchanger 32 during a cooling operation, and guides the refrigerant compressed by the compressor 170 to the indoor unit 1*b* during a heating operation.

The outdoor heat exchanger 32 condenses the refrigerant compressed by the compressor 170 during cooling operation, and evaporates the refrigerant decompressed in the indoor unit 1*b* during heating operation. The outdoor heat exchanger 32 may include an outdoor heat exchanger refrigerant pipe (not shown) through which the refrigerant passes, and an outdoor heat exchanger cooling fin (not shown) to increase a surface area in contact with outdoor air. An increase in the contact surface area between the outdoor heat exchanger refrigerant pipe (not shown) and outdoor air may improve a heat exchange efficiency between the refrigerant and outdoor air.

An outdoor blower fan 162 is located around the outdoor heat exchanger 32 to flow outdoor air to the outdoor heat exchanger 32. The outdoor blower fan 164 may blow outdoor air before heat exchange to the outdoor heat exchanger 32 and simultaneously blow the heat-exchanged air outdoors.

In addition to decompressing the refrigerant, the expansion valve 190 may adjust the amount of refrigerant provided to the outdoor heat exchanger 32 to ensure sufficient heat exchange in the outdoor heat exchanger 32. Specifically, the expansion valve 190 may decompress the refrigerant using a throttling effect of the refrigerant in which a pressure decreases without heat exchange with the outside as the refrigerant passes through a narrow flow path. An electronic expansion valve (EEV) with adjustable opening may be used to control the amount of refrigerant passing through the expansion valve 190.

The indoor unit 1*b* may include the indoor heat exchanger 30 and a blower fan assembly 160. The indoor heat exchanger 30 performs heat exchange between indoor air and refrigerant. The blower fan assembly 160 may flow indoor air to the indoor heat exchanger 30. The blower fan assembly 160 may include a plurality of indoor blower fans 161, 162, and 163.

The indoor heat exchanger 30 evaporates low-pressure liquid refrigerant during a cooling operation, and condenses high-pressure gaseous refrigerant during a heating operation. Like the outdoor heat exchanger 32 of the outdoor unit 1*a*, the indoor heat exchanger 30 includes an indoor heat exchanger refrigerant pipe (not shown) through which the refrigerant passes and an indoor heat exchanger cooling fin (not shown) to improve a heat exchange efficiency between the refrigerant and indoor air.

The blower fan assembly 160 may be located around the indoor heat exchanger 30 to blow indoor air to the indoor heat exchanger 30. The indoor heat exchanger 30 may perform heat exchange with indoor air. The blower fan assembly 160 may blow indoor air before heat exchange to the indoor heat exchanger 30 and simultaneously blow the heat-exchanged air indoors.

During a cooling operation, the refrigerant may release heat from the outdoor heat exchanger 32 and absorb heat from the indoor heat exchanger 30. That is, during a cooling operation, the refrigerant compressed in the compressor 170 may be first supplied to the outdoor heat exchanger 32 through the four-way valve 180 and then to the indoor heat exchanger 30. In this case, the outdoor heat exchanger 32 may operate as a condenser that condenses the refrigerant, and the indoor heat exchanger 30 may operate as an evaporator that evaporates the refrigerant.

During a cooling operation, the high-temperature and high-pressure gaseous refrigerant discharged from the compressor 170 moves to the outdoor heat exchanger 32, and the liquid or near-liquid refrigerant condensed in the outdoor heat exchanger 32 is expanded and decompressed in the expansion valve 190. Two-phase refrigerant that has passed through the expansion valve 190 moves to the indoor heat exchanger 30. The refrigerant flowing into the indoor heat exchanger 30 exchanges heat with air and evaporates. Accordingly, a temperature of the heat-exchanged air decreases and cold air is discharged to the outside of the indoor unit 1*b*.

During a heating operation, the refrigerant may release heat from the indoor heat exchanger 30 and absorb heat from the outdoor heat exchanger 32. That is, during a heating operation, the refrigerant compressed in the compressor 170 may be first supplied to the indoor heat exchanger 30 through the four-way valve 180 and then to the outdoor heat exchanger 32. In this case, the indoor heat exchanger 30 may operate as a condenser that condenses the refrigerant, and the outdoor heat exchanger 32 may operate as an evaporator that evaporates the refrigerant.

During a heating operation, the high-temperature and high-pressure gaseous refrigerant discharged from the compressor 170 moves to the indoor heat exchanger 30, and the high-temperature and high-pressure gaseous refrigerant passing through the indoor heat exchanger 30 exchanges heat with low-temperature and dry air. The refrigerant is condensed into a liquid or near-liquid refrigerant and releases heat, and as the air absorbs the heat, warm air is discharged to the outside of the indoor unit 1*b*.

Hereinafter, a configuration of the indoor unit 1*b* is described in detail.

Referring to FIG. 1 and FIG. 3, the indoor unit 1*b* may include a housing 10 forming an exterior, the blower fan assembly 160 circulating air inside or outside the housing 10, and the indoor heat exchanger 30 exchanging heat with the air flowing into the housing 10. The housing 10 may be referred to as an 'indoor unit housing.'

The housing 10 may include a body case 11 on which the blower fan assembly 160 and the heat exchanger 30 are mounted, and a front panel 40 covering a front of the body case 11. In addition, the housing 10 may include a first inlet 12, a second inlet 15, a main outlet 17, and guide outlets 13 and 14.

The body case 11 may form a rear surface, a left surface, a right surface, an upper surface, and a lower surface of the indoor unit 1*b*. The front of the body case 11 may be open, and the open front may form a body case opening 11*a*. The body case opening 11*a* may be covered by a first frame 16, a second frame 53, a support frame 17*a*, and the front panel 40.

The front panel 40 may be coupled to the housing 10 by the first frame 16. The front panel 40 may include a discharge area 41 including a plurality of holes 42 and a blocking area 43 in which the plurality of holes 42 are not formed. The plurality of holes 42 may penetrate the front panel 40. The plurality of holes 42 may be uniformly distributed over an entire area of the front panel 40. Heat-exchanged air passing through the main outlet 17 may be discharged to the outside of the housing 10 through the plurality of holes 42. A moving speed of the heat-exchanged air discharged through the plurality of holes 42 may be relatively slower than a moving speed of the air discharged through the guide outlets 13 and 14. Because no hole is included in the blocking area 43, air cannot pass through the blocking area 43.

The first frame 16 may be coupled to the front of the body case 11, i.e., the body case opening 11*a*. The second frame 53 may be coupled to a front of the first frame 16. The support frame 17*a* may be disposed between the first frame 16 and the second frame 53 and may support the first frame 16 and the second frame 53. The first frame 16 and the front panel 40 may be separable from the body case 11.

The first frame 16 may include the main outlet 17. The main outlet 17 may be disposed in the front of the housing 10. The main outlet 17 may penetrate the first frame 16. The main outlet 17 may be formed in an upper portion of the first frame 16. The main outlet 17 may be disposed to face the first inlet 12. The air heat-exchanged in the housing 10 may be discharged to the outside of the housing 10 through the main outlet 17. The main outlet 17 may discharge air introduced through the first inlet 12.

The support frame 17*a* supporting the front panel 40 may be coupled to a portion of the first frame 16 where the main outlet 17 is formed. The support frame 17*a* may extend along a circumference of the main outlet 17. The support frame 17*a* may support a rear surface of the front panel 40.

The first inlet 12 formed in the body case 11 may penetrate a rear surface of the body case 11. The first inlet 12 may be formed in an upper portion of the rear surface of the body case 11. External air may flow into the housing 10 through the first inlet 12.

At least one first inlet 12 may be provided, and a plurality of first inlets 12 may be provided depending on the design. A shape of the first inlet 12 may be rectangular. The inlet 12 may be provided in various shapes depending on the design.

The second inlet 15 may penetrate the rear surface of the body case 11 and may be formed in a lower portion of the rear surface of the body case 11. The second inlet 15 may be formed below the first inlet 12. External air may flow into the housing 10 through the second inlet 15. The number and shape of the second inlets 15 may vary by design.

The first frame 16 may form the guide outlets 13 and 14 together with the front panel 40. The guide outlets 13 and 14 may be formed on the same side as the main outlet 17. The guide outlets 13 and 14 may be disposed adjacent to the main outlet 17. The guide outlets 13 and 14 may be arranged to be spaced apart from the main outlet 17 by a predetermined distance. The guide outlets 13 and 14 may be formed on the left and/or right sides of the main outlet 17. The guide outlets 13 and 14 may include the first guide outlet 13 disposed on the left side of the main outlet 17 and the second guide outlet 14 disposed on the right side of the main outlet 17.

The guide outlets 13 and 14 may extend along a vertical direction of the body case 11. The guide outlets 13 and 14 may have the same length as the main outlet 17. Air that is not heat-exchanged in the housing 10 may be discharged to the outside of the housing 10 through the guide outlets 13 and 14. The guide outlets 13 and 14 may discharge air introduced through the second inlet 15.

Referring to FIG. 4 and FIG. 5, the guide outlets 13 and 14 may be configured to mix the air discharged from the guide outlets 13 and 14 with the air discharged from the main outlet 17. Specifically, a portion of the first frame 16 forming the guide outlets 13 and 14 may be provided with guide curved portions 13*a* and 14*a* for guiding the air discharged from the guide outlets 13 and 14 in order to mix the air discharged from the guide outlets 13 and 14 with the air discharged from the main outlet 17.

The air discharged through the guide outlets 13 and 14 may be discharged along the guide curved portions 13*a* and 14*a* in a direction where the air discharged through the guide outlets 13 and 14 may be mixed with the air discharged from the main outlet 17. The guide curved portions 13*a* and 14*a* may guide the air discharged through the guide outlets 13 and 14 to be discharged in approximately the same direction as the air discharged through the main outlet 17. The guide curved portions 13*a* and 14*a* may be configured to guide the air discharged through the guide outlets 13 and 14 forward.

Blades 61 and 62 may be provided on the guide outlets 13 and 14 to guide the air discharged through the guide outlets 13 and 14. The blades 61 and 62 may be continuously arranged along a longitudinal direction of the guide outlets 13 and 14. The first blade 61 may be disposed in the first guide outlet 13, and the second blade 62 may be disposed in the second guide outlet 14.

An air flow path connecting the first inlet 12 and the main outlet 17 is referred to as a first flow path S1, an air flow path connecting the second inlet 15 and the first guide outlet 13 is referred to as a second flow path S2, and an air flow path connecting the second inlet 15 and the second guide outlet 14 is referred to as a third flow path S3. The first flow path S1 may be separated from the second flow path S2 and the third flow path S3. The air flowing along the first flow path S1 inside the indoor unit 1*b* may not mix with the air flowing along the second flow path S2 and the third flow path S3 inside the indoor unit 1*b*. A portion of the second flow path S2 and the third flow path S3 may overlap. In the second flow path S2 and the third flow path S3, a portion from the second inlet 15 to a circular fan 165 may be common.

Referring again to FIG. 3, a first duct 18 may be disposed in the housing 10 to partition the first flow path S1 and the second flow path S2. The first duct 18 may be disposed on a left side of the blower fan assembly 160. The first duct 18 may extend along a vertical direction. The first duct 18 may communicate with the circular fan 165. The first duct 18 may communicate with a fan outlet 165*a* of the circular fan 165. The first duct 18 may guide a portion of the air flowing by the circular fan 165 to the first guide outlet 13. The first duct 18 may be provided with a first duct filter (not shown) to filter foreign substances in the air flowing in from the circular fan 165.

A second duct 19 may be disposed in the housing 10 to partition the first flow path S1 and the third flow path S3.

The second duct 19 may be disposed on a right side of the blower fan assembly 160. The second duct 19 may extend along the vertical direction. The second duct 19 may communicate with the circular fan 165. The second duct 19 may communicate with the fan outlet 165*a* of the circular fan 165. The second duct 19 may guide a portion of the air flowing by the circular fan 165 to the second guide outlet 14. The second duct 19 may be provided with a second duct filter 19*a* to filter foreign substances in the air flowing in from the circular fan 165.

Air that has exchanged heat with the indoor heat exchanger 30 may be discharged through the main outlet 17, and air that has not passed through the heat exchanger 30 may be discharged through the guide outlets 13 and 14. That is, the guide outlets 13 and 14 may be provided to discharge the air that has not been heat exchanged. Because the indoor heat exchanger 30 is disposed on the first flow path S1, the air discharged through the main outlet 17 may be heat-exchanged air. Because the indoor heat exchanger 30 is not disposed on the second flow path S2 and the third flow path S3, the air discharged through the guide outlets 13 and 14 may be air that has not been heat exchanged.

In an embodiment, a heat exchanger (not shown) may be disposed on the second flow path S2 and the third flow path S3. For example, a heat exchanger (not shown) may be provided in a receiving space 11*b* of the body case 11. In a case where a heat exchanger (not shown) is disposed on the second flow path S2 and the third flow path S3 as well, heat-exchanged air may be discharged through the guide outlets 13 and 14.

Electronic components (not shown) may be disposed in the receiving space 11*b* of the body case 11. For example, a control circuit and/or a drive circuit required for driving the air conditioner 1 may be disposed. In addition, the circular fan 165 may be disposed in the receiving space 11*b*.

The circular fan 165 may be driven independently from the blower fan assembly 160. A rotational speed of the circular fan 165 may be different from a rotational speed of each of the plurality of blower fans 161, 162, and 163 included in the blower fan assembly 160.

The blower fan assembly 160 may be disposed on the first flow path S1 from the first inlet 12 to the main outlet 17. Operation of the blower fan assembly 160 may allow air to flow into the housing 10 through the first inlet 12. The air introduced through the first inlet 12 may move along the first flow path S1 and be discharged to the outside of the housing 10 through the main outlet 17.

The blower fan assembly 160 may include at least one blower fan. For example, the blower fan assembly 160 may include the first blower fan 161, the second blower fan 162, and the third blower fan 163. In FIG. 3, the three blower fans 161, 162, and 163 are shown, but the blower fan assembly 160 may include two blower fans, or may include various numbers of blower fans depending on the design.

The first blower fan 161, the second blower fan 162, and the third blower fan 163 may be arranged in the vertical direction of the indoor unit housing 10. In the blower fan assembly 160, the first blower fan 161 may be arranged at the bottom, the third blower fan 163 may be arranged at the top, and the second blower fan 162 may be disposed between the first blower fan 161 and the third blower fan 163. The first blower fan 161, the second blower fan 162, and the third blower fan 163 may have the same structure.

The blower fans 161, 162, and 163 may each include an axial flow fan or a mixed flow fan. In addition, the blower fans 161, 162, and 163 may be configured in various shapes and/or various types of fans that may discharge air introduced from the outside of the housing 10 back to the outside of the housing 10. For example, the blower fans 161, 162, and 163 may be cross fans, turbo fans, or sirocco fans.

The circular fan 165 may be disposed on the second flow path S2 and the third flow path S3 from the second inlet 15 to the guide outlets 13 and 14. Air may be introduced into the housing 10 through the second inlet 15 by the circular fan 165. A portion of the air introduced through the second inlet 15 may move along the second flow path S2 and may be discharged to the outside of the housing 10 through the first guide outlet 13, or may move along the third flow path S3 and may be discharged to the outside of the housing 10 through the second guide outlet 14.

The indoor heat exchanger 30 may be disposed between the blower fan assembly 160 and the first inlet 12. The indoor heat exchanger 30 may be disposed on the first flow path S1. The indoor heat exchanger 30 may absorb heat from air introduced through the first inlet 12, or may transfer heat to the air introduced through the first inlet 12. The indoor heat exchanger 30 may include a tube and a header coupled to the tube. However, the type of indoor heat exchanger 30 is not limited thereto.

The indoor unit 1*b* may include a first intake grille 51 coupled to a portion of the body case 11 where the first inlet 12 is formed. The first intake grille 51 may prevent foreign substances from entering through the first inlet 12. To this end, the first intake grille 51 may include a plurality of slits or holes. The first intake grille 51 may cover the first inlet 12.

The indoor unit 1*b* may include a second intake grille 52 coupled to a portion of the body case 11 where the second inlet 15 is formed. The second intake grille 52 may prevent foreign substances from entering through the second inlet 15. To this end, the second intake grille 52 may include a plurality of slits or holes. The second intake grille 52 may cover the second inlet 15.

The indoor unit 1*b* may include the second frame 53 coupled to a portion of the first frame 16. The second frame 53 may be mounted on the support frame 17*a*. The second frame 53 may prevent foreign substances from being discharged through the main outlet 17. To this end, the second frame 53 may include a plurality of slits or holes. The second frame 53 may cover the main outlet 17.

The indoor unit 1*b* may include a distribution device 55. The distribution device 55 may be disposed in the housing 10. For example, the distribution device 55 may be disposed in the receiving space 11*b* of the body case 11. The distribution device 55 may be disposed adjacent to the fan outlet 165*a* of the circular fan 165. The distribution device 55 may be disposed in a portion where air introduced through the second inlet 15 branches toward the first guide outlet 13 and the second guide outlet 14. The distribution device 55 may be arranged between the first inlet 12 and the second inlet 15. The distribution device 55 may be configured to distribute air blown by the circular fan 165 to the first duct 18 and the second duct 19. The distribution device 55 may be configured to adjust a flow rate of air discharged through the first guide outlet 13 and the second guide outlet 14.

Referring again to FIG. 4, the air conditioner 1 may be operated in a first mode for discharging heat-exchanged air through the main outlet 17. In the first mode, external air may be introduced into the housing 10 through the first inlet 12 by an operation of the blower fan assembly 160, and the introduced air passes through the heat exchanger 30 to exchange heat. The heat-exchanged air may be discharged to the outside of the housing 10 through the main outlet 17. A wind speed of the heat-exchanged air may be reduced as the heat-exchanged air passes through the plurality of holes 42 of the front panel 40. The above configuration may allow an indoor space to be cooled or heated at a wind speed that is comfortable for a user. The circular fan 165 does not operate in the first mode, and thus air is not discharged through the guide outlets 13 and 14.

Referring again to FIG. 5, the air conditioner 1 may be operated in a second mode for discharging air that has not been heat exchanged through the guide outlets 13 and 14. Because no heat exchanger is disposed on the second flow path S2 and the third flow path S3, the indoor unit 1*b* may circulate indoor air. Because the guide outlets 13 and 14 are provided with the guide curved portions 13*a* and 14*a*, air discharged through the guide outlets 13 and 14 may be discharged toward the front of the indoor unit 1*b*. The blades 61 and 62 are provided on the guide outlets 13 and 14, and thus air may be blown further forward.

As the circular fan 165 is driven, air outside the housing 10 may flow into the housing 10 through the second inlet 15. The air introduced into the housing 10 may pass through the circular fan 165 and then move to the second flow path S2 and the third flow path S3 formed on both sides of the first flow path S1, respectively. The air may move upward on the second flow path S2 and the third flow path S3, and then be discharged to the outside of the housing 10 through the guide outlets 13 and 14. In this instance, the air may be guided to the front of the air conditioner 1 along the guide curved portions 13*a* and 14*a*.

The blower fan assembly 160 is not driven in the second mode, and thus air is not discharged through the main outlet 17. That is, the air conditioner 1 blows air that has not been heat exchanged in the second mode, and thus the air conditioner 1 may simply perform a function of circulating indoor air.

In addition, the air conditioner 1 may be operated in a third mode for discharging heat-exchanged air through the main outlet 17 and discharging air that has not been heat exchanged through the guide outlets 13 and 14. The air conditioner 1 may move cold or warm air farther in the third mode than in the first mode.

While the air conditioner 1 is driven in the third mode, the cold or warm air discharged through the main outlet 17 and the air discharged through the guide outlets 13 and 14 may be mixed. In addition, the air discharged through the guide outlets 13 and 14 may move at a relatively faster speed than the heat-exchanged air discharged through the main outlet 17. The air discharged through the guide outlets 13 and 14 may move the heat-exchanged air discharged through the main outlet 17 further. According to such a configuration, the air conditioner 1 may provide a user with comfortable cold or warm air in which the heat-exchanged air and indoor air are mixed.

Figure 6:
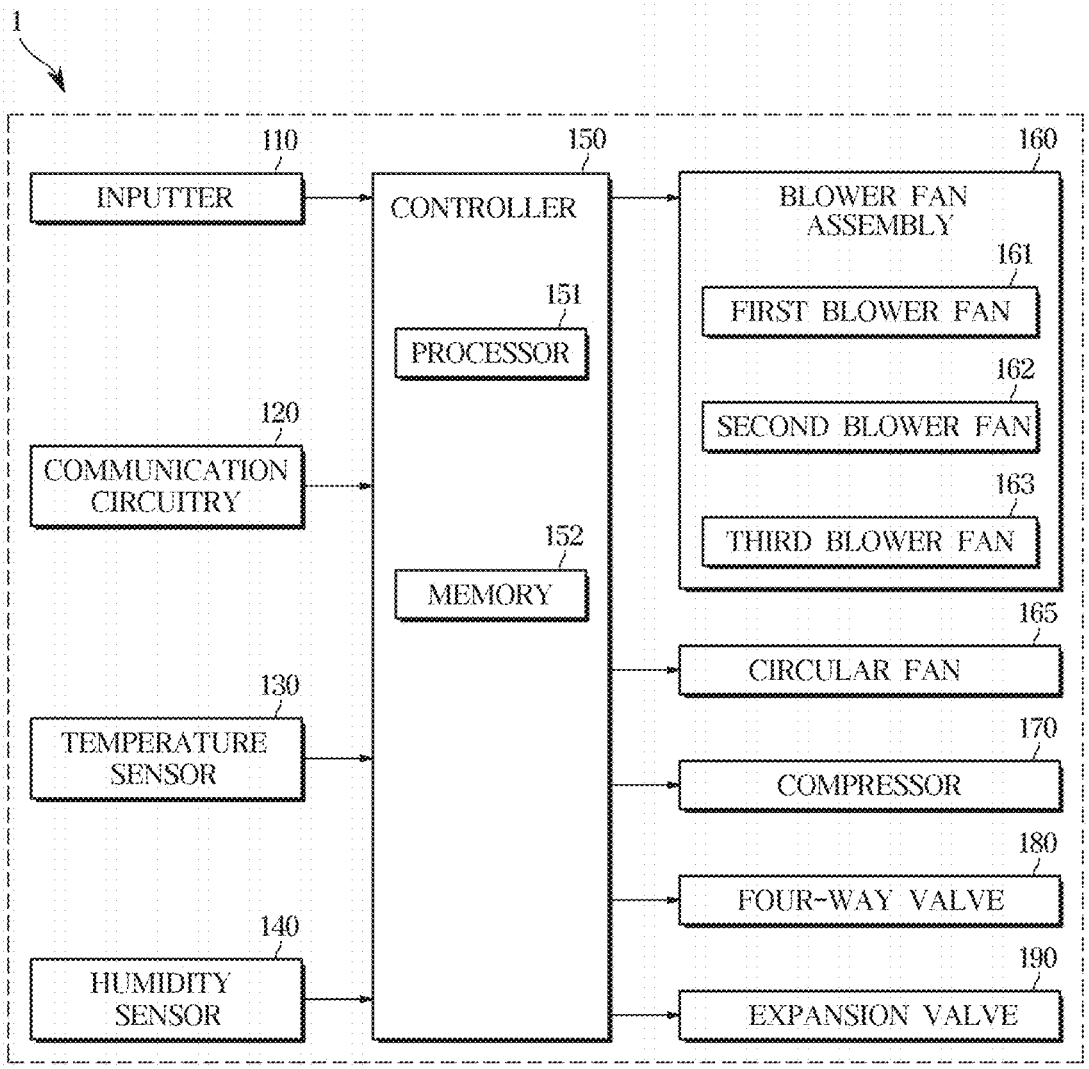
FIG. 6 is a control block diagram of an example air conditioner according to various embodiments.

FIG. 6 is a control block diagram of an example air conditioner according to various embodiments.

Referring to FIG. 6, the air conditioner 1 may include an input device(s) (or inputter) 110 (including, e.g., input circuitry), communication circuitry 120, a temperature sensor 130, a humidity sensor 140, a controller 150, the blower fan assembly 160, the circular fan 165, the compressor 170, the four-way valve 180, and the expansion valve 190.

The input device 110, the communication circuitry 120, the temperature sensor 130, a memory 152, the controller 150, and the blower fan assembly 160 may be arranged in the indoor unit (1*b*). In addition, the indoor unit (1*b*) may include the circular fan 165. The compressor 170, the four-way valve 180, and the expansion valve 190 may be included in the outdoor unit 1*a*. The controller 150 may be electrically connected to the components of the air conditioner 1 and may control an operation of each component. The outdoor unit 1*a* may also include a processor.

Some of the components (e.g., circular fan) of the air conditioner 1 shown in FIG. 6 may be omitted. In addition, components other than those shown in FIG. 6 may be added to the air conditioner 1. It will be easily understood by those skilled in the art that the mutual positions of the components may be modified according to the performance or structure of the system.

The input device 110 may include input circuitry and obtain user input related to an operation of the air conditioner 1 from a user. In addition, the input device 110 may transmit an electrical signal (voltage or current) corresponding to the user input to the controller 150. The controller 150 may control the operation of the air conditioner 1 based on the electrical signal transmitted from the inputter 110.

The input device 110 may, for example, include a plurality of buttons provided on the housing 10 of the indoor unit 1*b*. For example, the input device 110 may include an operation mode button for selecting a cooling operation or heating operation, a temperature button for setting a target temperature of an indoor space (air conditioning space), a wind direction button for setting a wind direction, and/or an air volume button for setting a wind intensity (rotation speed of fan).

In addition, according to an embodiment, the input device 110 may include a humidity button for setting target humidity of the indoor space. The input device 110 receives the target humidity input from the user and transmits a signal for controlling the compressor 170 to the controller 170 based on the target humidity. The input device 110 receives a target temperature and target humidity from the user and transmits a signal for controlling the compressor 170 to the controller 170 based on the target temperature and target humidity.

The plurality of buttons may include a push switch operated by a user pressing the push switch, a membrane switch, and/or a touch switch operated by touching a part of the user's body.

The input device 110 may include a remote controller provided separately from the air conditioner 1 and a receiver receiving a wireless signal from the remote controller. The remote controller may also include a plurality of buttons such as an operation mode button, a temperature button, a humidity button, a wind direction button, and an air volume button.

The communication circuitry 120 may communicate with an access point (AP, not shown) provided separately in the air conditioning space, and may be connected to a network through the access point. The communication circuitry 120 may communicate with a user terminal device (e.g., a smartphone) through the access point. The communication circuitry 120 may receive information about the user terminal device connected to the access point, and may transmit the information about the user terminal device to the controller 150. In addition, the communication circuitry 120 may receive location information (e.g., a global positioning system (GPS) signal) of the user terminal device from the user terminal device, and may transmit the received location information to the controller 150. To this end, the communication circuitry 120 may include a known wired communication module or wireless communication module.

At least one temperature sensor 130 may be provided at various positions of the air conditioner 1. For example, the temperature sensor 130 may be provided on the front panel 40 of the indoor unit housing 10 and may measure a temperature of heat-exchanged air discharged through the front panel 40. Also, the temperature sensor 130 may be disposed in a portion of the indoor heat exchanger 30 (e.g., front surface of the indoor heat exchanger 30), and may measure a temperature of air heat-exchanged while passing through the indoor heat exchanger 30. In addition, the temperature sensor 130 may detect a condensation temperature of refrigerant condensed in the indoor heat exchanger 30 during a heating operation. In a case where a plurality of temperature sensors 130 are provided, an electrical signal (voltage or current) corresponding to each measured temperature may be transmitted to the controller 150.

In addition to the above, the temperature sensor 130 may be disposed at a position to measure a temperature of the indoor space where the indoor unit 1*b* is placed and a position to measure a temperature of the air flowing into the first inlet 12 and the second inlet 15. The temperature sensor 130 may include, for example, a thermistor whose electrical resistance value changes depending on temperature.

The humidity sensor 140 may detect indoor humidity (outside of the air conditioner) and transmit an electrical signal (voltage or current) indicating the detected humidity to the controller 150. For example, the humidity sensor 140 may include a material whose electrical resistance value or capacitance changes depending on humidity.

The humidity sensor 140 may detect humidity of indoor air that has not passed through the indoor heat exchanger 30. The humidity sensor 140 may be located upstream of the indoor heat exchanger 30 in an air flow caused by the blower fan assembly 160.

In addition, the humidity sensor 140 may detect humidity of the inside of the air conditioner 1 (inside the housing) and transmit an electrical signal (voltage or current) indicating the detected humidity to the controller 150. The humidity sensor 140 may be provided at various positions of the air conditioner 1 according to the above-described purpose. Meanwhile, the temperature sensor 130 and the humidity sensor 140 may be integrated and provided at various positions of the air conditioner 1.

The controller 150 may include the memory 152 that registers and/or stores programs, instructions, and data for controlling an operation of the air conditioner 1, and a processor 151 that generates a control signal for controlling an operation of the air conditioner 1 based on the programs, instructions, and data retained and/or stored in the memory 152. The controller 150 may be implemented as a control circuit with the processor 151 and the memory 152 mounted thereon. In addition, the controller 150 may include a plurality of processors and a plurality of memories. The processor 151 may include various processing circuitry (e.g., logic circuits and arithmetic circuits) and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The memory 152 may register/store various information required for operation of the air conditioner 1. The memory 152 may store instructions, applications, data, and/or programs required for operation of the air conditioner 1.

For example, the memory 152 may store a target indoor temperature, target indoor humidity, fuzzy table, control conditions according to startup that are input or initially set by a user. For example, the memory 152 may store the fuzzy table shown in FIG. 7. The fuzzy table may assign an adjustment value of the compressor 170 for each index to allow the air conditioner 1 to follow a target temperature. The adjustment value is a value determined to continuously adjust an operating frequency of the compressor 170, and may be determined according to a difference E between an indoor temperature and the target temperature and the amount of indoor temperature change ΔE for one minute based on the present. A numerical index may be given to each of the differences E between the indoor temperature and the target temperature and the amount of indoor temperature change ΔE for one minute based on the present, and the controller 150 may determine the adjustment value according to the two indices. For example, during fuzzy control, in a case where the difference E between the indoor temperature and the target temperature is −1.5 and the amount of indoor temperature change ΔE for one minute is 0.6, the controller 150 may increase a current operating frequency of the compressor 170 by f1.

The memory 152 may include volatile memories, such as a static random access memory (S-RAM), a dynamic random access memory (D-RAM) for temporarily storing data, and non-volatile memories, such as a read only memory (ROM), an erasable programmable read only memory (EPROM), an electrically erasable programmable read only memory (EEPROM), and the like, for long term data storage.

The processor 151 may generate a control signal for controlling an operation of the air conditioner 1 based on the instructions, applications, and data stored in the memory 152. The processor 151 may include for example, a logic circuit and an arithmetic circuit in hardware. The processor 151 may process data according to the programs and/or instructions provided from the memory 152, and generate a control signal according the processing result. The memory 152 and the processor 151 may be implemented as a single control circuit or a plurality of circuits.

In response to a control signal from the controller 150, the compressor 170 may circulate refrigerant in a refrigerant circulation circuit including the compressor 170, the four-way valve 180, the outdoor heat exchanger 32, the expansion valve 190, and the indoor heat exchanger 30. Specifically, the compressor 170 may compress gaseous refrigerant and discharge high-temperature/high-pressure gaseous refrigerant. In addition, the compressor 170 may not operate in a blowing operation that does not require cooling or heating.

The four-way valve 180 may change a circulation direction of the refrigerant discharged from the compressor 170 under control of the controller 150. Specifically, the four-way valve 180 guides the refrigerant compressed in the compressor 170 to the outdoor heat exchanger 32 during cooling operation, and guides the refrigerant compressed in the compressor 170 to the indoor heat exchanger 30 during heating operation.

The expansion valve 190 may decompress the refrigerant. In addition, the expansion valve 190 may adjust the amount of refrigerant supplied to ensure sufficient heat exchange in the outdoor heat exchanger 32 or the indoor heat exchanger 30. The expansion valve 190 decompresses the refrigerant using a throttling effect of the refrigerant in which a pressure decreases as the refrigerant passes through a narrow flow path. The expansion valve 190 may be implemented as an electronic expansion valve (EEV) that may control the opening amount by an electrical signal.

The blower fan assembly 160 may include a plurality of blower fans 161, 162, and 163. The plurality of blower fans 161, 162, and 163 may flow air heat-exchanged in the indoor heat exchanger 30 to the outside of the indoor unit (1*b*, 200). An operation of the blower fan assembly 160 may allow external air to flow into the housing 10 through the first inlet 12. The air introduced into the housing 10 exchanges heat with the refrigerant flowing in the indoor heat exchanger 30 while passing through the indoor heat exchanger 30. The air heat exchanged by the indoor heat exchanger 30 may pass through the blower fan assembly 160, and may be discharged to the outside of the housing 10 through the main outlet 17 of the first frame 16 and the plurality of holes 42 of the front panel 40.

The plurality of blower fans 161, 162, and 163 included in the blower fan assembly 160 may operate under the control of the controller 150. Each of the plurality of blower fans 161, 162, and 163 may include a fan motor and may rotate using power generated by the fan motor. The plurality of blower fans 161, 162, and 163 may operate during cooling or heating operation.

The circular fan 165 may introduce external air into the indoor unit housing 10 and may discharge the introduced air to the outside of the indoor unit 1*b* through the guide outlets 13 and 14. An operation of the circular fan 165 may allow air to be introduced into the housing 10 through the second inlet 15. A portion of the air introduced through the second inlet 15 may move along the second flow path S2 and may be discharged to the outside of the housing 10 through the first guide outlet 13, or may move along the third flow path S3 and may be discharged to the outside of the housing 10 through the second guide outlet 14.

The circular fan 165 may operate under the control of the controller 150. The circular fan 165 may include a fan motor and may rotate using power generated by the fan motor. For example, the circular fan 165 may operate during cooling or heating operation. The circular fan 165 may also operate during a blowing operation in which cooling and heating are not required.

Hereinafter, a control method of an air conditioner according to various embodiments is described in more detail. The control method described below is applicable to the air conditioner 1 according to the above-described embodiments.

Figure 8:
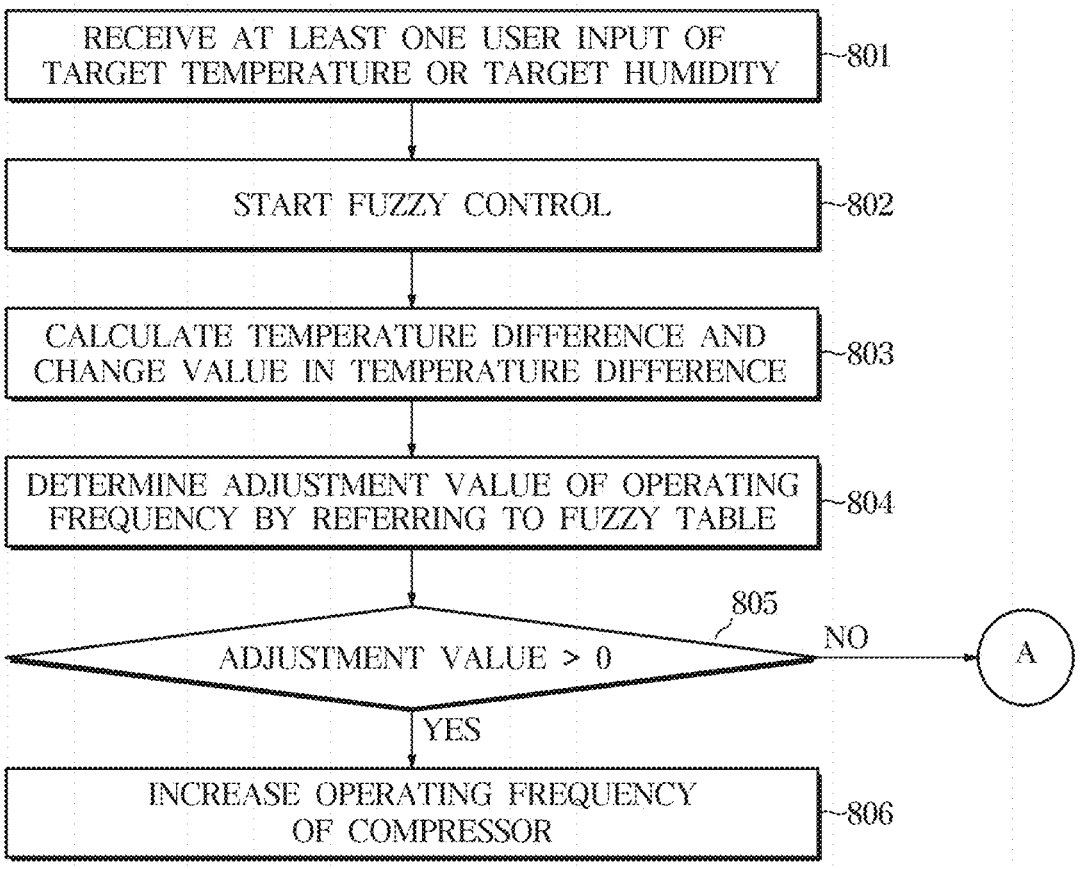
FIG. 8 and FIG. 9 are flowcharts of a control method of an example air conditioner according to various embodiments.
Figure 9:
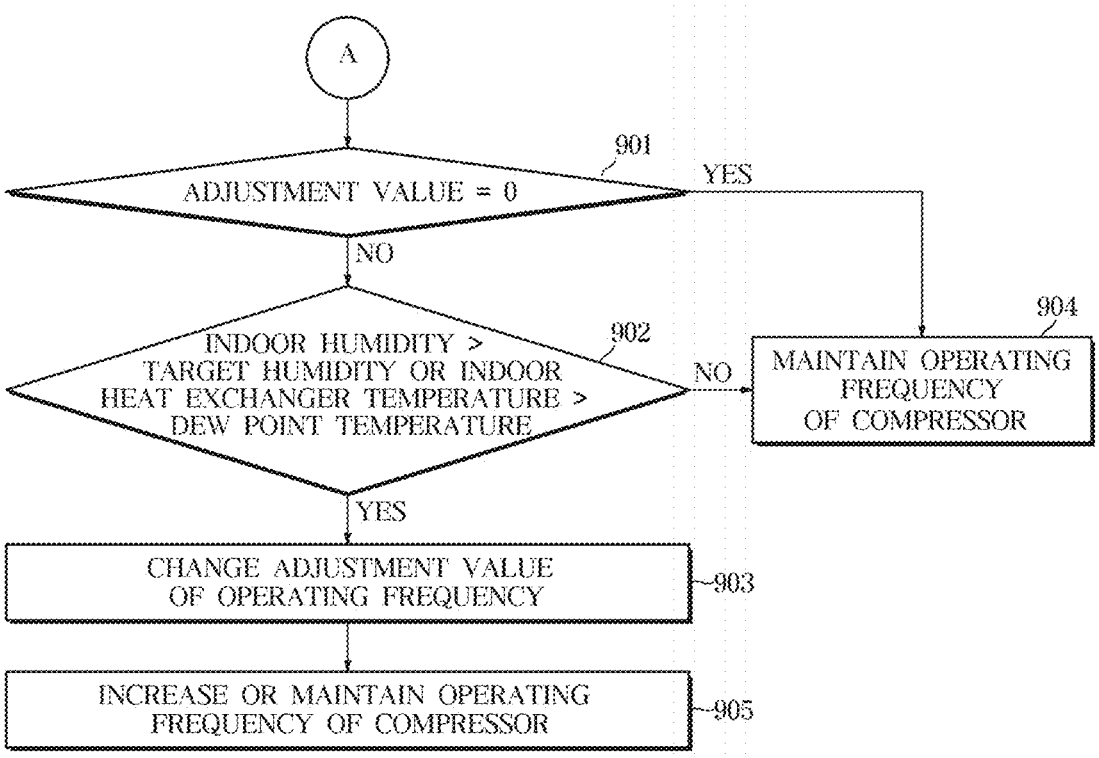
Figure 10:
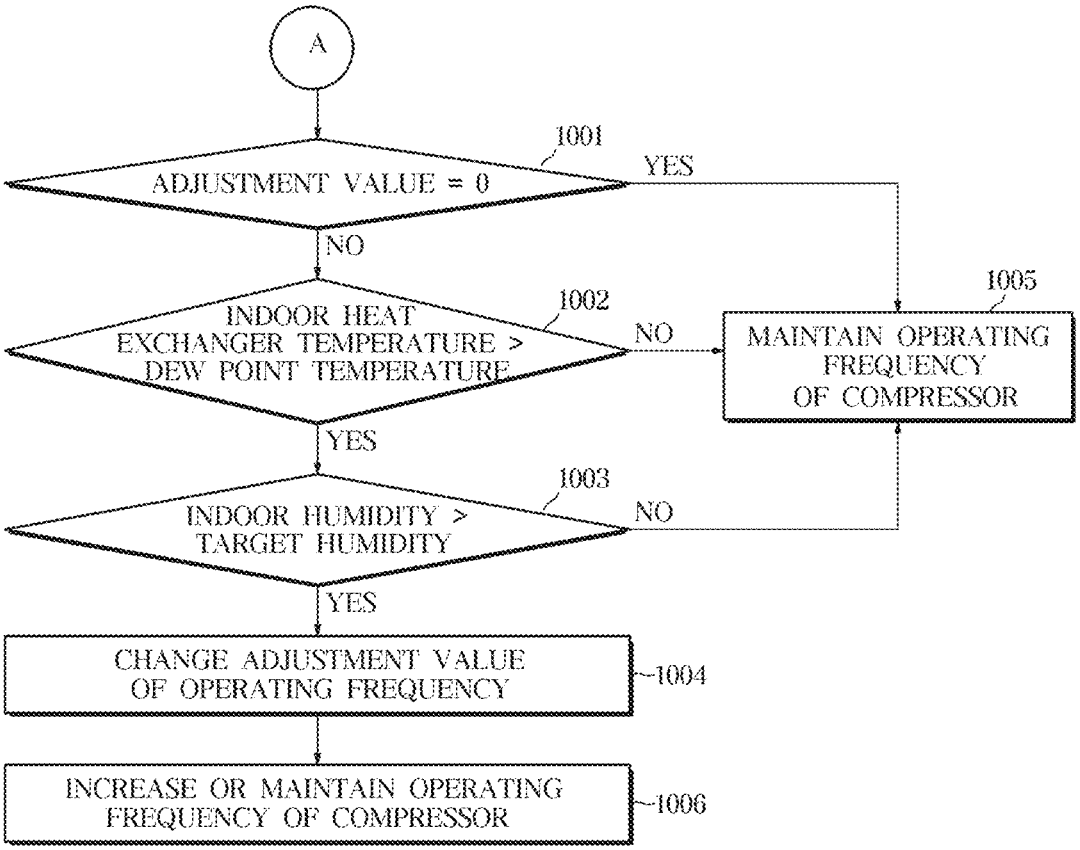
FIG. 10 is a flowchart of a control method of an example air conditioner according to various embodiments.
Figure 11:
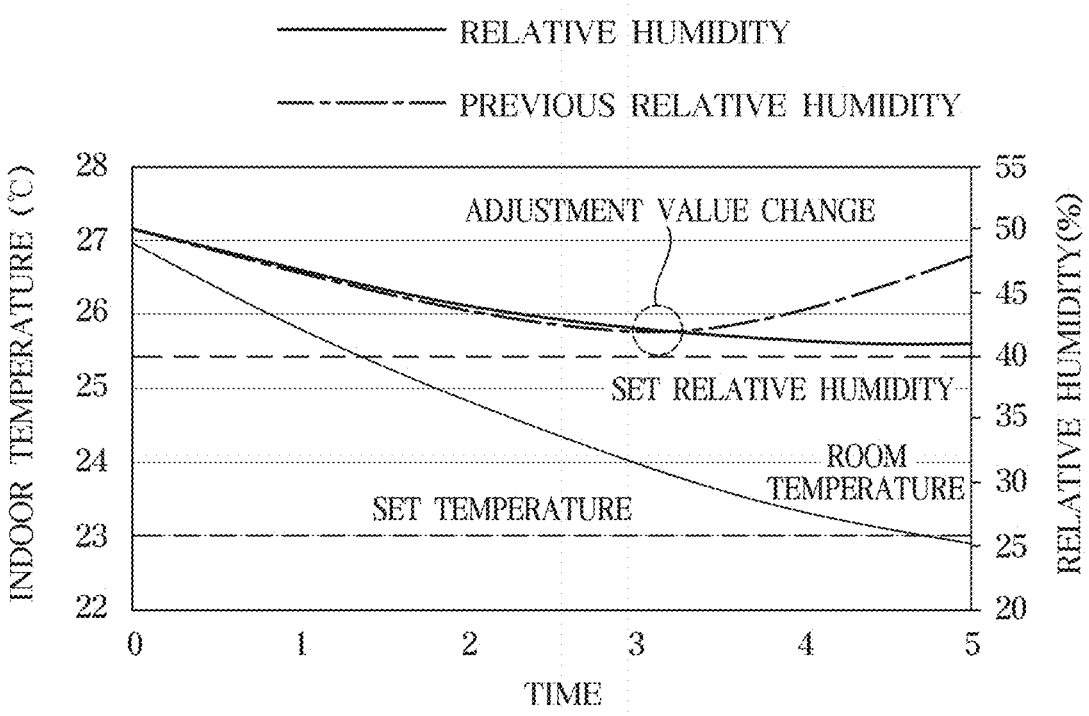
FIG. 11 illustrates an example in which a relative humidity is reduced during a cooling operation.
Figure 12:
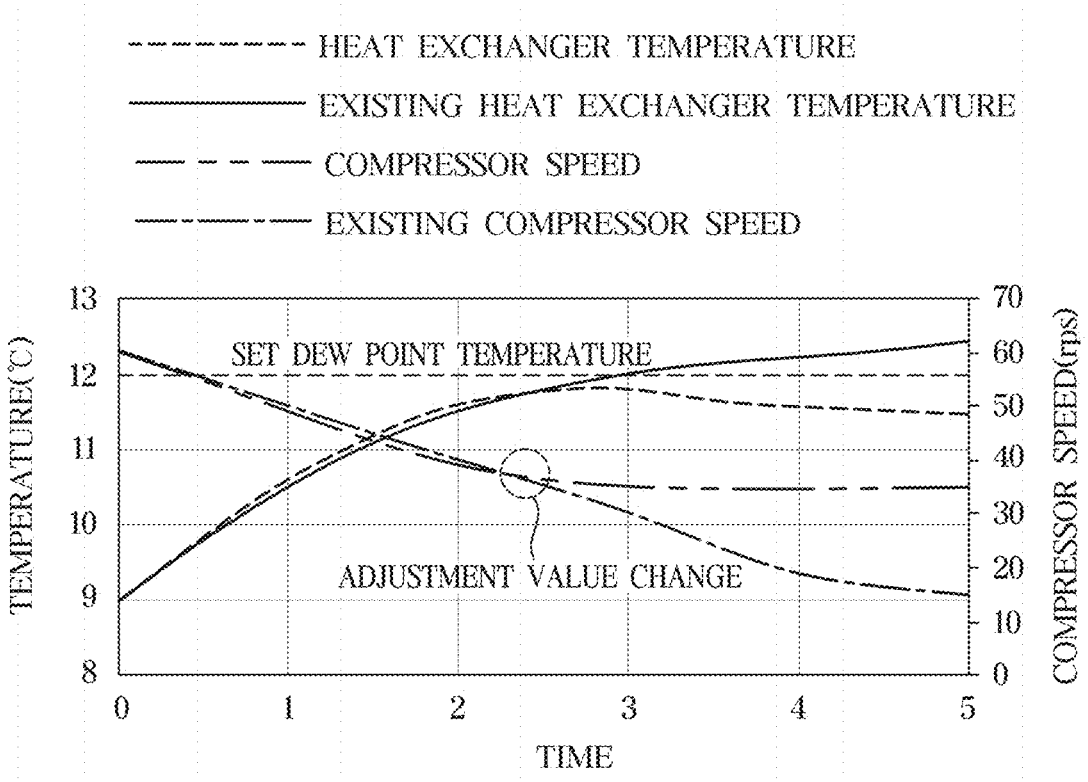
FIG. 12 illustrates a temperature drop of a heat exchanger according to a deceleration of a compressor.

FIG. 8 and FIG. 9 are flowcharts of control methods of an example air conditioner according to various embodiments. FIG. 10 is a flowchart of a control method of an example air conditioner according to various embodiments. FIG. 11 illustrates an example in which a relative humidity is reduced during a cooling operation. FIG. 12 illustrates a temperature drop of a heat exchanger according to a deceleration of a compressor. The control methods of the air conditioner described in FIGS. 8, 9, and 10 will be described with reference to FIG. 11 and FIG. 12.

The controller 150 receives at least one user input for a target temperature or target humidity (801). Specifically, the input device 110 receives an input about the target temperature and/or target humidity from a user, and transmits an electrical signal corresponding to the target temperature and/or target humidity to the controller 150.

Unlike existing air conditioners, according to various embodiments of the disclosure, the target humidity may be input in addition to the target temperature. The air conditioner according to an embodiment may control the compressor 170 in response to the user input for setting the target humidity.

The air conditioner 1 performs fuzzy control according to the user input (802). Fuzzy control refers to, for example, a control method that periodically adjusts an operating frequency of the compressor 170 to allow a temperature of the air cooled by the indoor heat exchanger 30 to follow the target temperature. In response to an indoor temperature reaching a predetermined threshold temperature, the controller 150 may increase or decrease the operating frequency of the compressor 170 to allow the temperature to follow the target temperature. For example, the controller 150 may reduce the operating frequency of the compressor 170 in a case where an indoor temperature approaches the target temperature, or may increase the operating frequency of the compressor 170 in a case where a difference between the indoor temperature and the target temperature is above a predetermined level. In this instance, the controller 150 may determine an adjustment value of the operating frequency using, for example, a pre-stored fuzzy table. The controller 150 may determine the amount of increase or the amount of decrease of the operating frequency by referring to the fuzzy table.

In addition, to compensate for limits of fuzzy control, the controller 200 may additionally perform compressor switching control. Compressor switching control refers to, for example, a control method for switching the compressor on or off.

The fuzzy table may be configured to reduce the compressor frequency as the indoor heat exchanger temperature gradually decreases, and to increase the operating frequency of the compressor as the indoor heat exchanger temperature gradual increases. In this instance, an adjustment value according to a relationship between a difference between an indoor temperature and a target temperature/the amount of indoor temperature change for a predetermined period of time (e.g., one minute) may be assigned to the fuzzy table.

The controller 150 calculates a temperature difference and the amount of change in temperature difference (803), and determines an adjustment value of the operating frequency by referring to the pre-stored fuzzy table (804). For example, the controller 150 calculates the temperature difference between the target temperature and the indoor temperature, and calculates the amount of indoor temperature change for a predetermined period of time. The controller 150 adjusts the operating frequency of the compressor 170 to the adjustment value corresponding to the calculated value.

In response to the adjustment value being greater than 0 during fuzzy control (805), the controller 150 controls the operating frequency of the compressor to increase (806). In this case, the indoor temperature is far below the target temperature, and thus a cooling intensity may be increased by increasing an operating speed of the compressor 170.

Meanwhile, FIG. 9 shows control of adjustment value in a case where the adjustment value is not greater than 0.

In response to the adjustment value being 0 by the fuzzy table (901), the controller 150 maintains the operating frequency of the compressor 170 according to the adjustment value assigned to the fuzzy table (904).

In a case where the indoor temperature approaches the target temperature, the air conditioner 1 adjusts the operating frequency of the compressor 170 by applying the adjustment value less than 0 according to the fuzzy table. Specifically, the controller 150 controls the operating frequency to be lowered with the adjustment value having a negative value and prevents a rapid drop in the indoor temperature. However, the indoor temperature rises due to a sharp decrease in compressor speed, resulting in an increase in indoor humidity.

In an embodiment, the compressor 170 may be operated by the pre-stored fuzzy table, but under predetermined conditions, the operating frequency of the compressor 170 may be controlled without using the fuzzy table. According to an embodiment, under predetermined conditions, the controller 150 may change the adjustment value of the operating frequency in response to a user input for target humidity, as opposed to the adjustment value assigned to the fuzzy table.

According to an embodiment, the controller 150 may change the adjustment value of the operating frequency based on indoor humidity. In addition, the controller 150 may change the adjustment value based on a temperature of the indoor heat exchanger (evaporator).

In response to the adjustment value being less than 0, the controller 150 compares the indoor humidity and the target humidity, or compares the indoor heat exchanger temperature and a dew point temperature (902).

The controller 150 changes the adjustment value of the operating frequency based on the comparison result (903). Specifically, the controller 150 may maintain the operating frequency of the compressor 170 for a predetermined period of time by applying the adjustment value of the operating frequency as 0 in order to prevent a speed of the compressor 170 from decreasing rapidly due to fuzzy control.

According to an embodiment, the controller 150 may change the adjustment value of the operating frequency in response to the indoor heat exchanger temperature exceeding the dew point temperature Td. The controller 150 controls the compressor 170 to allow the indoor heat exchanger temperature to be lower than the dew point temperature. In other words, by maintaining the temperature of the indoor heat exchanger below the dew point temperature, condensation may be prevented from occurring on a surface of the indoor heat exchanger. In this instance, the dew point temperature Td may be obtained based on the target temperature and the target humidity, and a dew point temperature calculation formula stored in the memory 152 may be used.

In addition, according to an embodiment, the controller 150 may change the adjustment value in response to a difference between the indoor heat exchanger temperature and the dew point temperature Td exceeding a predetermined weight. In this instance, the weight is a factor for compensating a measured temperature value of heat exchanger, and may be set to various values depending on, for example, experimental result and a location of the temperature sensor 130.

The controller 150 may change the adjustment value to allow the indoor heat exchanger temperature to be maintained below the dew point temperature. In this instance, the controller 150 obtains the indoor heat exchanger temperature according to a predetermined time period and changes the adjustment value of the operating frequency to allow the indoor heat exchanger temperature to follow a value below the dew point temperature (903).

In general, in a case where the indoor temperature approaches the target temperature, the controller 150 lowers the operating frequency of the compressor by applying a negative adjustment value to the fuzzy control, and prevents a rapid decrease in indoor temperature. In contrast, in a case where the indoor temperature is higher than the target temperature above a predetermined level, the controller 150 increases the operating frequency of the compressor by applying a positive adjustment value to the fuzzy control and lowers the indoor temperature.

The adjustment value is a value that may change according to a predetermined time period, and may be determined based on the difference between the indoor temperature and the target temperature and the amount of indoor temperature change for a predetermined period of time. Referring to FIG. 7, an example of correlation between the adjustment value and factors determining the adjustment value may be seen.

In fuzzy control, the adjustment value depends on the indoor temperature and the target temperature. However, according to the disclosure, in a case where target humidity is input by a user to the air conditioner 1, the compressor 170 may be controlled in response to the user input without considering the adjustment value assigned to the fuzzy table, the indoor temperature, and the target temperature. According to an embodiment, in response to detecting a user input for the target humidity, the controller 150 may maintain the operating frequency of the compressor 170 that performs fuzzy control regardless of the fuzzy table. For example, even in a case where an adjustment value assigned to the fuzzy table is −f1 at some point, the operating frequency of the compressor 170 may be maintained by applying an adjustment value of 0. That is, the controller 150 may control the operating frequency of the compressor 170 by applying the adjustment value of 0 in some period while the fuzzy control is performed.

In addition, according to an embodiment, the controller 150 may determine the number of times the adjustment value is changed based on a level of target humidity. For example, in a case where target humidity input by a user is low and an indoor temperature is close to a target temperature, the indoor humidity may be lowered by maintaining the operating frequency of the compressor 170. That is, as the target humidity decreases, the number of times the adjustment value is changed increases, and as the target humidity increases, the number of times the adjustment value is changed decreases.

Although the adjustment value is changed to 0 in the example above, an adjustment value may be a positive number other than 0.

In addition, the air conditioner 1 may further include the humidity sensor 140 and may change the adjustment value of the operating frequency based on indoor humidity. According to an embodiment, the controller 150 may change the adjustment value in response to the indoor humidity obtained from the humidity sensor 140 being greater than a target humidity. In this instance, the target humidity corresponds to a value set by the user through the input device 110. In response to the input target humidity, the controller 150 may obtain current indoor humidity and change the adjustment value based on a comparison between the indoor humidity and the target humidity input by the user. In this instance, the adjustment value may be determined based on the target humidity input by the user. For example, in a case where the user inputs relatively low target humidity, the indoor humidity may be further lowered by applying the adjustment value greater than 0 instead of 0.

Controlling the operating frequency of the compressor 170 described above may be performed before the indoor temperature reaches the target temperature. Accordingly, the controller 150 changes the adjustment value of the operating frequency before the indoor temperature reaches the target temperature. In this instance, the controller 150 may change the adjustment value, from the time that a temperature difference between the target temperature and the indoor temperature is less than or equal to a predetermined temperature difference.

That is, in a case where the indoor humidity is higher than the target humidity or the indoor heat exchanger temperature is higher than the dew point temperature while performing the fuzzy control, the controller 150 may maintain the operating frequency of the compressor 170 by changing the adjustment value of the fuzzy table. In addition, the controller 150 may increase the operating frequency of the compressor 170 by applying an adjustment value having a positive value in a case where a difference between the indoor humidity and the target humidity or a difference between the indoor heat exchanger temperature and the dew point temperature is above a predetermined level (905).

Meanwhile, unlike the embodiment shown in FIG. 9, referring to FIG. 10, the controller 150 may change the determined adjustment value of the operating frequency based on relative humidity and a temperature of the heat exchanger (evaporator). That is, the embodiment according to FIG. 10 may relieve fuzzy control by considering both the relative humidity and the heat exchanger temperature.

Referring to FIG. 10, similar to FIG. 9, adjustment value control in a case where the adjustment value is not greater than 0 is shown. In response to the adjustment value being 0 by the fuzzy table (1001), the controller 150 maintains the operating frequency of the compressor 170 according to the adjustment value assigned to the fuzzy table (1005).

In response to the indoor heat exchanger temperature being greater than the dew point temperature Td (1002) and the indoor humidity obtained from the humidity sensor 140 being greater than the target humidity set by the user (1003), the controller 150 changes the adjustment value of the operating frequency (1004).

That is, while performing fuzzy control, in a case where the indoor heat exchanger temperature is higher than the dew point temperature and the indoor humidity is higher than the target humidity, the controller 150 may maintain the operating frequency of the compressor 170 by changing the adjustment value of the fuzzy table. In addition, in response to the difference between the indoor humidity and the target humidity and the difference between the indoor heat exchanger temperature and the dew point temperature being above a predetermined level, the controller 150 may increase the operating frequency of the compressor 170 by applying an adjustment value having a positive value (1006).

In a case where the air conditioner 1 relieves the fuzzy control based only on the indoor heat exchanger temperature, only condensation of water vapor that occurs later may be prevented, but humidity caused by water vapor that has already condensed may not be controlled. Accordingly, in the embodiment, the target humidity desired by the user may be provided by obtaining the current indoor humidity through the humidity sensor 140. In other words, according to the embodiment, user discomfort caused by already condensed water vapor may be relieved.

Referring to FIG. 11, set relative humidity is determined by a user input for the target humidity, and as the adjustment value assigned to the fuzzy control is changed, the operating frequency of the compressor 170 increases, and thus an actual room temperature has a lower value than the set temperature (target temperature). However, it may be confirmed that the relative humidity is maintained at a lower value than existing relative humidity by the control according to the disclosure.

Referring to FIG. 12, as the adjustment value is changed, the degree of deceleration of the compressor 170 is reduced compared to before. In this instance, the indoor heat exchanger temperature has a lower value than an existing heat exchanger temperature, and the temperature of the indoor heat exchanger may be maintained below the set dew point temperature. Accordingly, condensation does not occur in the indoor heat exchanger, and the air conditioner 1 may maintain a constant level of comfort.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that may be interpreted by a computer. For example, the computer-readable recording medium may be a Read Only Memory (ROM), a Random Access Memory (RAM), a magnetic tape, a magnetic disk, a flash memory, an optical data storage device, etc.

The machine-readable storage medium may be provided in the form of a non-transitory storage medium. Here, when a storage medium is referred to as "non-transitory," it may be understood that the storage medium is tangible and does not include a signal (e.g., an electromagnetic wave), but rather that data is semi-permanently or temporarily stored in the storage medium. For example, a "non-transitory storage medium" may include a buffer in which data is temporarily stored.

According to an embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed through an application store (e.g., Play Store™) online. In the case of online distribution, at least a portion of the computer program product may be stored at least semi-permanently or may be temporarily generated in a storage medium, such as a memory of a server of a manufacturer, a server of an application store, or a relay server.

While the disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. An air conditioner, comprising:

a compressor configured to compress a refrigerant;

an indoor heat exchanger configured to perform heat exchange between the refrigerant and indoor air;

a temperature sensor configured to measure an indoor temperature and an indoor heat exchanger temperature;

an input device, including input circuitry, configured to receive a target temperature and target humidity from a user; and at least one processor, including processing circuitry, configured to determine an adjustment value of an operating frequency of the compressor based on a temperature difference between the target temperature and the indoor temperature, and change the determined adjustment value of the operating frequency based on the target humidity and the indoor heat exchanger temperature in response to the indoor beat exchanger temperature exceeding the dew point temperature.

2. The air conditioner of claim 1, wherein the at least one processor is configured to change the adjustment value, in response to a difference between the indoor heat exchanger temperature and a dew point temperature being greater than a predetermined weight.

3. The air conditioner of claim 2, wherein the at least one processor is configured to obtain the dew point temperature based on the target temperature and the target humidity.

4. The air conditioner of claim 2, wherein the at least one processor is configured to change the adjustment value to allow the indoor heat exchanger temperature to be maintained below the dew point temperature.

5. The air conditioner of claim 2, further comprising:

a humidity sensor configured to measure indoor humidity, wherein the at least one processor is configured to change the adjustment value in response to the indoor humidity obtained from the humidity sensor being equal to or greater than the target humidity.

6. The air conditioner of claim 1, wherein the at least one processor is configured to maintain the operating frequency of the compressor by changing the adjustment value of the operating frequency to 0.

7. The air conditioner of claim 1, wherein the at least one processor is configured to determine a magnitude of the changed adjustment value based on the target humidity.

8. The air conditioner of claim 1, wherein the at least one processor is configured to determine the temperature difference and the adjustment value of the operating frequency corresponding to a change value of the temperature difference with reference to a pre-stored fuzzy table.

9. The air conditioner of claim 8, wherein the at least one processor is configured to change the adjustment value of the operating frequency before the indoor temperature reaches the target temperature.

10. The air conditioner of claim 1, wherein the at least one processor is configured to change the adjustment value, from a time that the temperature difference is equal to or less than a predetermined temperature difference.

11. A control method of an air conditioner comprising a compressor configured to compress a refrigerant, an indoor heat exchanger configured to perform heat exchange between the refrigerant and indoor air, a temperature sensor configured to measure an indoor temperature and a heat exchanger temperature, and an input device, including input circuitry, configured to receive a target temperature and target humidity from a user, the control method comprising:

determining an adjustment value of an operating frequency of the compressor based on a temperature difference between the target temperature and the indoor temperature; and changing the determined adjustment value of the operating frequency based on the target humidity and the indoor heat exchanger temperature in response to the indoor heat exchanger temperature exceeding the dew point temperature.

12. The control method of claim 11, wherein the changing of the adjustment value of the operating frequency comprises changing the adjustment value, in response to a difference between the indoor heat exchanger temperature and a dew point temperature being greater than a predetermined difference.

13. The control method of claim 12, further comprising:

obtaining the dew point temperature based on the target temperature and the target humidity.

14. The control method of claim 12, wherein the changing of the adjustment value of the operating frequency comprises changing the adjustment value to allow the indoor heat exchanger temperature to be maintained below the dew point temperature.

15. The control method of claim 12, wherein the air conditioner further comprises a humidity sensor configured to measure indoor humidity, and the changing of the adjustment value of the operating frequency comprises changing the adjustment value, in response to the indoor humidity obtained from the humidity sensor being equal to or greater than the target humidity.

16. A non-transitory computer-readable storage medium comprising a program configured to:

determining an adjustment value of an operating frequency of a compressor of an air conditioner based on a temperature difference between a target temperature and an indoor temperature; and change the determined adjustment value of the operating frequency based on a target humidity and a temperature of an indoor heat exchanger of the air conditioner in response to the indoor heat exchanger temperature exceeding the dew point temperature.

17. An air conditioner comprising the non-transitory computer-readable storage medium of claim 16.

* * * * *